US006647592B2

(12) United States Patent
Presley

(10) Patent No.: US 6,647,592 B2
(45) Date of Patent: Nov. 18, 2003

(54) FOUR BAR HINGE

(75) Inventor: William T Presley, Macomb Township, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 9 days.

(21) Appl. No.: 10/013,293

(22) Filed: Oct. 29, 2001

(65) Prior Publication Data

US 2002/0073507 A1 Jun. 20, 2002

Related U.S. Application Data

(60) Provisional application No. 60/256,605, filed on Dec. 19, 2000.

(51) Int. Cl.[7] ..... E09D 3/06
(52) U.S. Cl. ..... 16/366; 16/288; 16/294
(58) Field of Search ..... 16/366, 288, 287, 16/294, 302

(56) References Cited

U.S. PATENT DOCUMENTS

| | | | | | |
|---|---|---|---|---|---|
| 3,339,226 | A | * | 9/1967 | Brown | 16/288 |
| 4,223,483 | A | | 9/1980 | Stafford | |
| 4,502,182 | A | * | 3/1985 | Lautenschlager et al. | 16/288 |
| 4,658,475 | A | | 4/1987 | Kinaga et al. | |
| 4,700,983 | A | | 10/1987 | Kinaga et al. | |
| 4,713,862 | A | | 12/1987 | Kinaga et al. | |
| 4,716,623 | A | * | 1/1988 | Kinaga et al. | 16/371 |
| 4,719,665 | A | * | 1/1988 | Bell | 16/232 |
| 4,720,895 | A | | 1/1988 | Peebles | |
| 4,738,003 | A | | 4/1988 | Mori et al. | |
| 4,807,331 | A | | 2/1989 | Calucci | |
| 4,864,687 | A | | 9/1989 | Calcaterra et al. | |
| 4,888,854 | A | | 12/1989 | Russell et al. | |
| 5,404,618 | A | | 4/1995 | Heiler et al. | |
| 5,444,894 | A | | 8/1995 | Heiler | |
| 5,491,875 | A | | 2/1996 | Siladke et al. | |
| 5,500,985 | A | | 3/1996 | Klueger | |
| 5,557,829 | A | | 9/1996 | Schoen et al. | |
| 5,561,887 | A | | 10/1996 | Neag et al. | |
| 5,611,114 | A | | 3/1997 | Wood, Jr. et al. | |
| 5,682,646 | A | | 11/1997 | Tyler, IV et al. | |
| 5,685,046 | A | | 11/1997 | Neag et al. | |
| 6,038,738 | A | | 3/2000 | Neag et al. | |
| 6,052,870 | A | | 4/2000 | Hagenlocher et al. | |
| 6,175,991 | B1 | * | 1/2001 | Driesman et al. | 16/366 |

FOREIGN PATENT DOCUMENTS

| | | |
|---|---|---|
| FR | 2574108 | 6/1986 |
| GB | 2203483 A | 10/1998 |
| JP | 585170 | 4/1993 |

* cited by examiner

*Primary Examiner*—Anthony Knight
*Assistant Examiner*—Lisa Bannapradist
(74) *Attorney, Agent, or Firm*—Donald J. Wallace

(57) ABSTRACT

A hinge mechanism for mounting a vehicle door structure to a vehicle body having first, second, third and fourth hinge members and a plurality of pin members. The first and fourth hinge members are coupled to the vehicle body and the vehicle door, respectively. The pin members pivotably couple the second and third hinge members to the first and fourth hinge members, permitting the vehicle door structure to pivot relative to the vehicle body between a closed position and an open position. The second and third hinge members are configured to resist a seal force that is exerted to the vehicle door by a weatherstrip seal to inhibit an outer surface of the vehicle door from skewing relative to an outer surface of the vehicle body in response to the seal force.

9 Claims, 5 Drawing Sheets

FOUR BAR HINGE

This application claims the benefit of U.S. Provisional Application No. 60/256,605, filed Dec. 19, 2000.

BACKGROUND OF THE INVENTION

1. Technical Field

The present invention relates generally to hinge mechanisms and more particularly to a hinge mechanism for a vehicle door having a four-member construction.

2. Discussion

Conventional door hinge mechanisms permit a vehicle door to be moved between a closed position wherein the vehicle door substantially closes a door aperture, and an open position wherein the vehicle door is skewed to a lateral side of the vehicle. Generally, conventional door hinge mechanisms pivot the vehicle door as the vehicle door is being moved toward the open position such that the forward edge of the vehicle door is located within the door aperture. Accordingly, hinge mechanisms constructed in this manner are known to have two drawbacks.

The first drawback is related to the arc or path of the vehicle door as it is placed into the open position. As conventional door hinge mechanisms pivot the vehicle door in a backward and inboard motion (i.e., the front edge of the vehicle door moves rearward and into the door aperture), vehicle designers were limited in the design of the front edge of the vehicle door due to the possibility of interference with the lateral side of the vehicle body when the vehicle door was moved between the closed and open positions.

A second drawback with the hinge mechanisms that utilize a backward and inboard motion when the vehicle door is opened is that such designs tend to orient the vehicle door relative to the door aperture in a manner which inhibits the ingress and egress of the vehicle. More specifically, the placement of the forward edge of the vehicle door in the door aperture limits the space available for ingress and egress. This drawback is particularly noticeable with vehicles that have relatively small doors, such as those generally found on sports cars.

One hinge developed to overcome these problems is disclosed in commonly assigned co-pending U.S. patent application Ser. No. 09/612,892 entitled "Four Member Door Hinge", the disclosure of which is hereby incorporated by reference as if fully set forth herein. This hinge mechanism, however, is susceptible to the force that is exerted by the compression of a weatherstrip seal between the vehicle body and the door when the vehicle door is positioned in the closed position; the force exerted by the weatherstrip seal is not resisted by the hinge members, causing the hinge to open. As this force is highly variable, extensive shimming is necessary to fit the hinge to a particular application. Accordingly, there remains a need in the art for a hinge mechanism that overcomes these problems.

SUMMARY OF THE INVENTION

In one preferred form, the present invention provides a hinge mechanism for mounting a vehicle door structure to a vehicle body. The hinge mechanism includes first, second, third and fourth hinge members and a plurality of pin members. The first hinge member is fixedly but removably coupled to the vehicle body and the fourth hinge member is fixedly but removably coupled to the vehicle door. The pin members pivotably couple the second and third hinge members to the first and fourth hinge members, permitting the hinge mechanism to pivotably couple the vehicle door structure to the vehicle body such that the vehicle door structure is movable between a closed position substantially closing the door aperture and an open position substantially clearing the door aperture. The second and third hinge members are configured to resist a seal force that is exerted to the vehicle door by a weatherstrip seal to thereby inhibit the seal force from skewing an outer surface of the vehicle door relative to an outer surface of the vehicle body.

BRIEF DESCRIPTION OF THE DRAWINGS

Additional advantages and features of the present invention will become apparent from the subsequent description and the appended claims, taken in conjunction with the accompanying drawings, wherein:

DETAILED DESCRIPTION OF THE PREFERRED EMBODIMENT

Figure 1:
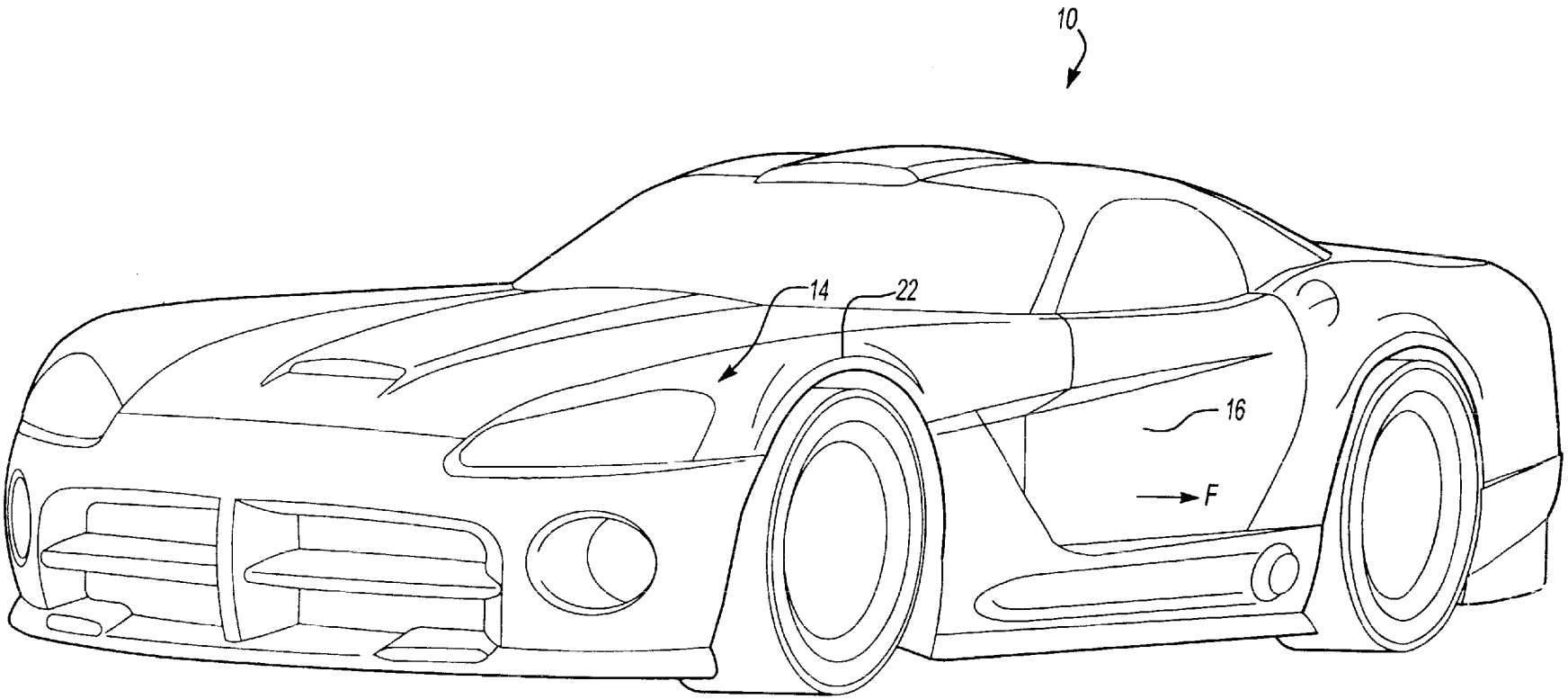
FIG. 1 is a perspective view of a vehicle constructed in accordance with the teachings of the present invention.
Figure 2:
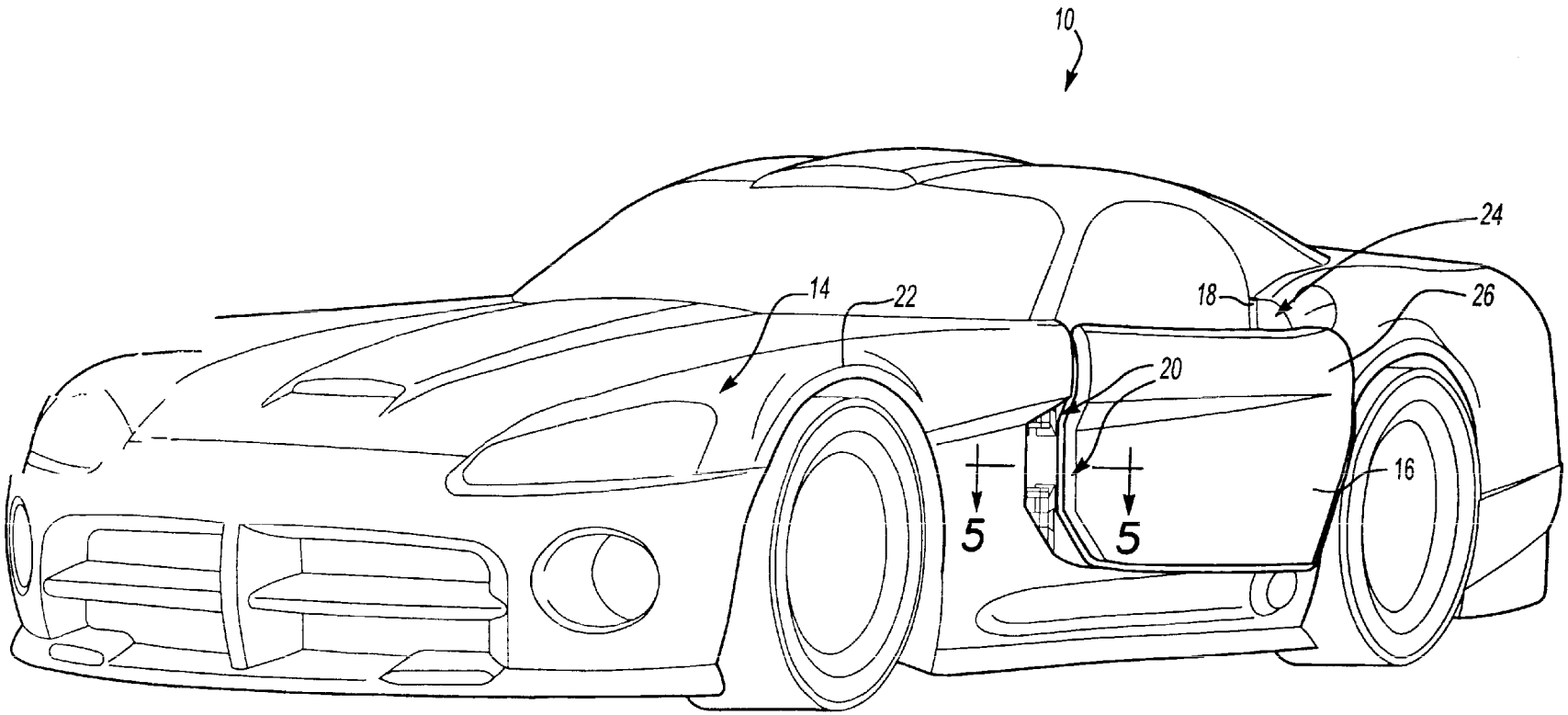
FIG. 2 is a perspective view of a portion of the vehicle of FIG. 1 illustrating the vehicle door in an open position.

With reference to FIGS. 1 and 2 of the drawings, a vehicle constructed in accordance with the teachings of the present invention is generally indicated by reference numeral 10. Vehicle 10 is shown to include a vehicle body 14, a vehicle door 16, a weatherstrip seal 18 and a hinge mechanism 20. Vehicle body 14 includes a lateral side 22 that defines a door aperture 24. Hinge mechanism 20 is coupled to vehicle body 14 and vehicle door 16, permitting vehicle door 16 to be pivoted between a closed position as illustrated in FIG. 1 and an open position as illustrated in FIG. 2. Placement of vehicle door 16 in the closed position permits vehicle door 16 to substantially close door aperture 24 and aligns the outer surface 26 of vehicle door 16 to the lateral side 22 of vehicle body. Placement of vehicle door 16 in the open position permits vehicle door to substantially clear door aperture 24.

In the particular example provided, weatherstrip seal 18 is formed in a conventional manner from a resilient sealing material and is thereafter coupled to vehicle body 14. Alternatively, weatherstrip seal 18 may be coupled to vehicle door 16. Weatherstrip seal 18 is positioned between vehicle body 14 and vehicle door 16 to sealingly engage vehicle door 16 when vehicle door 16 is placed in the closed position. Accordingly, weatherstrip seal 18 prevents foreign materials, such as dirt and moisture, from entering vehicle body 14 through door aperture 24 when vehicle door 16 is closed. As weatherstrip seal 18 is deformed (non-permanently) by its contact with vehicle door 16, it exerts a seal force F onto vehicle door 16 which tends to push vehicle door 16 out of the closed position.

Figure 3:
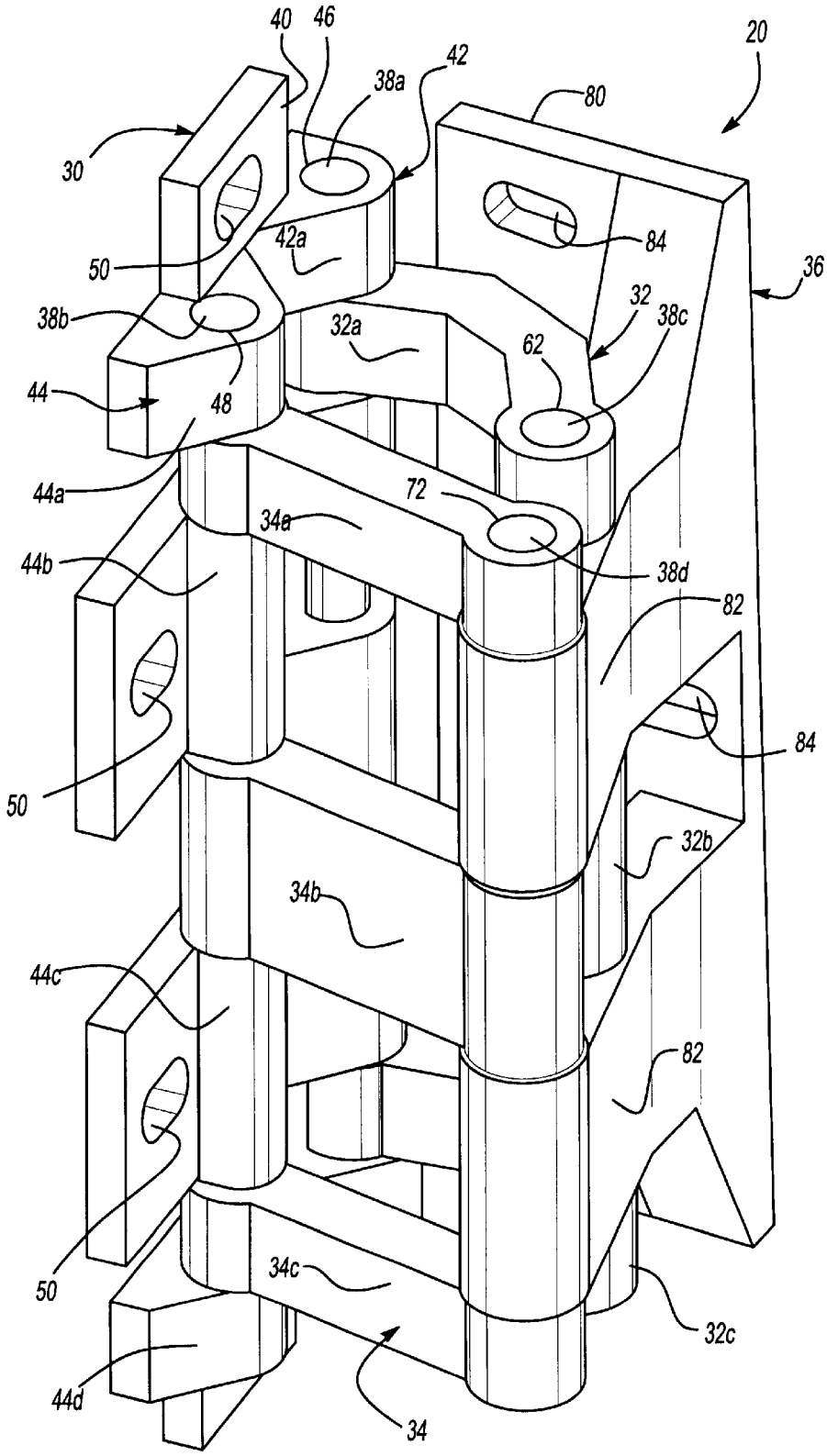
FIG. 3 is a perspective view of a portion of the vehicle of FIG. 1, illustrating the hinge mechanism of the present invention in greater detail.
Figure 4:
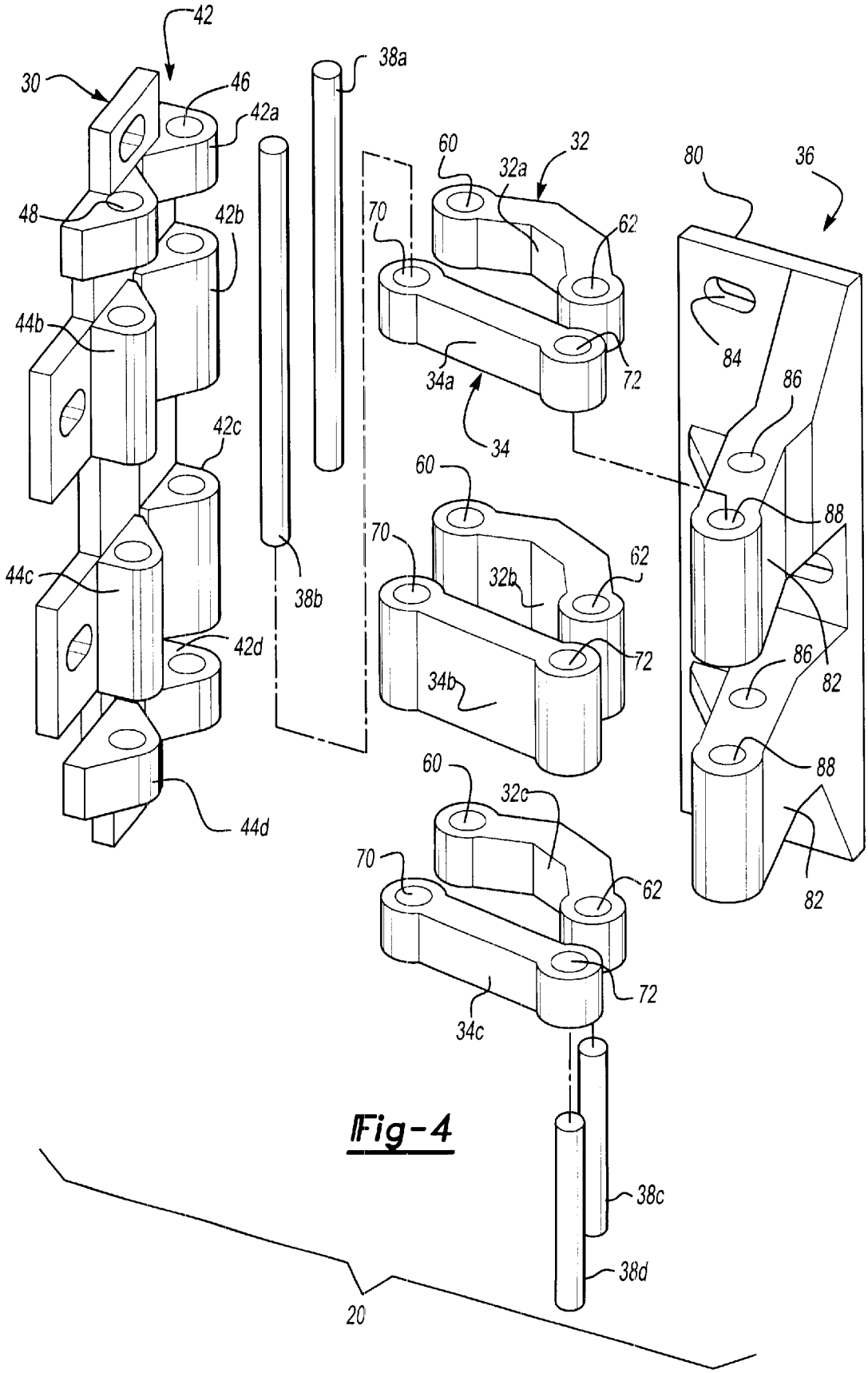
FIG. 4 is an exploded perspective view of the hinge mechanism of the present invention.

In FIGS. 3 and 4, hinge mechanism 20 is shown to include a first hinge member 30, a set of second hinge members 32, a set of third hinge members 34, a fourth hinge member 36 and a plurality of hinge pins 38*a*, 38*b*, 38*c* and 38*d*. First hinge member 30 is a generally planar member having a mounting flange 40 with a first set of protrusions 42, a second set of protrusions 44, a first pin aperture 46, a second pin aperture 48 and a plurality of mounting holes 50.

Conventional fasteners (not specifically shown) that extend through the mounting holes 50 are employed to fixedly but removably couple the first hinge member 30 to the vehicle body 14. The first set of protrusions 42 is coupled to the rearward side of the mounting flange 40 (i.e., the side opposite the vehicle body 14) and includes a first protrusion 42*a*, a second protrusion 42*b*, a third protrusion 42*c* and a fourth protrusion 42*d*. The first pin aperture 46 extends through the first set of protrusions 42 and is sized to receive hinge pin 38*a*. The second set of protrusions 44 is similarly coupled to the rearward side of the mounting flange 40 and includes a first protrusion 44*a*, a second protrusion 44*b*, a third protrusion 44*c* and a fourth protrusion 44*d*. The second pin aperture 48 extends through the second set of protrusions 44 and is sized to receive hinge pin 38*b*.

Each member 32*a*, 32*b* and 32*c* of the set of second hinge members 32 is generally J-shaped, having a third pin aperture 60 at its proximal end and a fourth pin aperture 62 at its distal end. The third and fourth pin apertures 60 and 62 are sized to receive hinge pins 38*a* and 38*c*, respectively. The set of second hinge members 32 is placed proximate the first hinge member 30 such that each of the members 32*a*, 32*b* and 32*c* is disposed between a pair of protrusions that form a portion of the first set of protrusions 42 (e.g., member 32*a* is disposed between protrusions 42*a* and 42*b*). Hinge pin 38*a* is disposed within the first and third pin apertures 46 and 60 and rotatably couples the first hinge member 30 to the set of second hinge members 32.

Each member 34*a*, 34*b* and 34*c* of the set of third hinge members 34 is generally straight, having a fifth pin aperture 70 at its proximal end and a sixth pin aperture 72 at its distal end. The fifth and sixth pin apertures 70 and 72 are sized to receive hinge pins 38*b* and 38*d*, respectively. The set of third hinge members 34 is placed proximate the first hinge member 30 such that each of the hinge members 34*a*, 34*b* and 34*c* is disposed between a pair of protrusions that form part of the second set of protrusions 44 (e.g., member 34*a* is disposed between protrusions 44*a* and 44*b*). Hinge pin 38*b* is disposed within the second and fifth pin apertures 48 and 70 and rotatably couples the first hinge member 30 to the set of third hinge members 34.

The fourth hinge member 36 is generally L-shaped, with the base of the "L" being employed as a mounting flange 80 and the leg of the "L" being formed by a pair of hinge arms 82. The mounting flange 80 is generally planar and includes a plurality of mounting apertures 84. Conventional fasteners (not shown) extend through the mounting apertures 84 and fixedly but removably couple the mounting flange 80 to the vehicle door 16. The hinge arms 82 are spaced vertically apart from one another and extend forwardly of the mounting flange 80. Each of the hinge arms 82 includes a seventh pin aperture 86 and an eighth pin aperture 88, with the seventh pin aperture 86 being disposed between the mounting flange 80 and the eighth pin aperture 88. The seventh and eighth pin apertures 86 and 88 are sized to receive hinge pins 38*c* and 38*d*, respectively.

The members 32*a*, 32*b* and 32*c* of the set of second hinge members 32 are placed proximate the fourth hinge member 36 such that member 32*a* is positioned above the pair of hinge arms 82, member 32*b* is disposed between the pair of hinge arms 82 and member 32*c* is disposed below the pair of hinge arms 82. Hinge pin 38*c* is disposed within the fourth and seventh pin apertures 62 and 86 and rotatably coupes the set of second hinge members 32 to the fourth hinge member 36. Similarly, the members 34*a*, 34*b* and 34*c* of the set of third hinge members 34 is placed proximate the fourth hinge member 36 such that member 34*a* is positioned above the pair of hinge arms 82, member 34*b* is disposed between the pair of hinge arms 82 and member 34*c* is disposed below the pair of hinge arms 82. Hinge pin 38*d* is disposed within the sixth and eighth pin apertures 72 and 88 and rotatably coupes the set of third hinge members 34 to the fourth hinge member 36.

Figure 5:
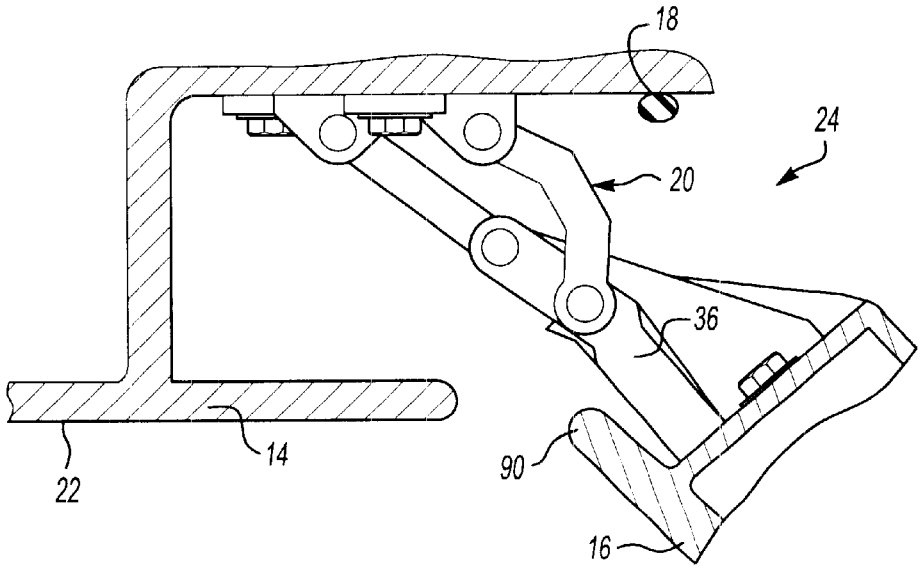
FIG. 5 is a partial sectional view of the vehicle of FIG. 1 illustrating the hinge mechanism as coupled to the vehicle body and vehicle door and positioned in a position between the closed and open positions.
Figure 7:
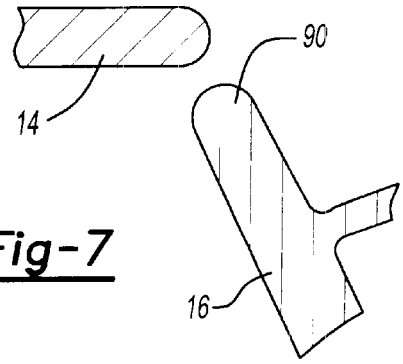
FIG. 7 is a partial sectional view of the vehicle of FIG. 1 illustrating the vehicle door as positioned in the open position.

As shown in FIGS. 5 and 7, configuration of the hinge mechanism 20 in this manner permits the fourth hinge member 36 to pivot outward relative to the lateral side 22 and forwardly of the door aperture 24 when the vehicle door is moved from the closed position to the open position. Accordingly, the hinge mechanism 20 permits the vehicle door 16 to be moved along an arcuate path such that a forward corner 90 of the vehicle door 16 swings outwardly as it pivots forwardly to thereby prevent the forward corner 90 from contacting the lateral side 22 of the vehicle body 14.

Figure 6:
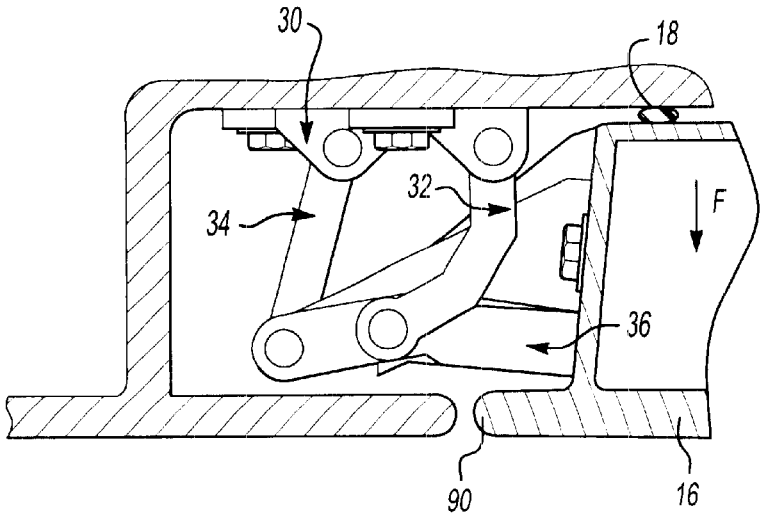
FIG. 6 is a partial sectional view similar to that of FIG. 5 but illustrating the hinge mechanism positioned in the closed position.

Also advantageously, configuration of the hinge mechanism 20 in this manner orients the sets of second and third hinge members 32 and 34 in an orientation that resists the seal force F that is exerted by the weatherstrip seal 18 when the vehicle door 16 is in the closed position. As illustrated in FIG. 6, the seal force F is transmitted by the fourth hinge member 36 in a manner that is resisted by the sets of second and third hinge members 32 and 34 to thereby prevent the vehicle door 16 from tending to rotate away from the closed position in response to the seal force F. The second and third hinge members resist the seal force in tension to position an outer surface of the vehicle door structure relative to an outer surface of the vehicle body when the vehicle door is in the closed position.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

I claim:

1. A vehicle comprising:

a vehicle body defining a door aperture;

a vehicle door structure;

a hinge mechanism having first, second, third and fourth hinge members and a plurality of pin members, the first hinge member being fixedly but removably coupled to the vehicle body, the fourth hinge member being fixedly but removably coupled to the vehicle door structure, the pin members pivotably coupling each of the second and third hinge members to each of the first and fourth hinge members, the hinge mechanism being operable for pivotably coupling the vehicle door structure to the vehicle body such that the vehicle door structure is movable between a closed position substantially closing the door aperture and an open position substantially clearing the door aperture; and a weatherstrip seal coupled to one of the vehicle body and the vehicle door structure and configured to abut the other one of the vehicle body and the vehicle door structure when the vehicle door structure is placed in the closed position, the weatherstrip seal exerting a seal force in a direction tending to urge the vehicle door structure toward the open position when the vehicle door structure is positioned in the closed position;

wherein the second and third hinge members are configured to resist the seal force to thereby inhibit the seal force from skewing an outer surface of the vehicle door structure relative to an outer surface of the vehicle body.

2. The vehicle of claim 1, wherein the first hinge member is a generally planar structure.

3. The vehicle of claim 2, wherein the first hinge member includes a plurality of integrally formed protrusions that are axially spaced from one another and a pin aperture, which is configured to receive an associated one of the pin members, is formed at least partially through the protrusions.

4. The vehicle of claim 1, wherein the second hinge member is generally J-shaped.

5. The vehicle of claim 1, wherein the third hinge member is generally straight.

6. The vehicle of claim 1, wherein the fourth hinge member is generally L-shaped.

7. The vehicle of claim 1, wherein a forward tip of the vehicle door structure is positioned outwardly of the vehicle body when the vehicle door structure is positioned in the open position.

8. The vehicle of claim 7, wherein the forward tip of the vehicle door structure is positioned forwardly of the door aperture when the vehicle door structure is positioned in the open position.

9. A vehicle comprising:

a vehicle body defining a door aperture;

a vehicle door structure;

a hinge mechanism for pivotably coupling the vehicle door structure to the vehicle body such that the vehicle door structure is movable between a closed position substantially closing the door aperture and an open position substantially clearing the door aperture, the hinge mechanism having a first hinge member, a plurality of second hinge members, a plurality of third hinge members, a fourth hinge member and a plurality of pin members, the first hinge member being fixedly but removably coupled to the vehicle body, the fourth hinge member being fixedly but removably coupled to the vehicle door structure, a first one of the pin members pivotably coupling the plurality of second hinge members to the first hinge member, a second one of the pin members pivotably coupling the second hinge member to the fourth hinge member, a third one of the pin members pivotably coupling the third hinge member to the first hinge member, a fourth one of the pin members pivotably coupling the third hinge member to the fourth hinge member; and a weatherstrip seal coupled to one of the vehicle body and the vehicle door structure and configured to abut the other one of the vehicle body and the vehicle door structure when the vehicle door structure is placed in the closed position, the weatherstrip seal exerting a seal force to the vehicle door structure toward the open position when the vehicle door structure is positioned in the closed position;

wherein the second hinge members rotate from a position that is aligned generally axially offset from a portion of the fourth hinge member to a position perpendicular to the vehicle body when the vehicle door structure is moved from the open position toward the closed position; and wherein a proximal portion of each of the third hinge members is coupled to the first hinge member, the proximal portions being positioned generally to resist the seal force when the vehicle door structure is placed in the closed position.

* * * * *